US011278085B2

(12) United States Patent
Frietsch

(10) Patent No.: US 11,278,085 B2
(45) Date of Patent: Mar. 22, 2022

(54) WRISTBAND WITH INTEGRATED POCKET

(71) Applicant: Sydney P Frietsch, Deer Creek, IL (US)

(72) Inventor: Sydney P Frietsch, Deer Creek, IL (US)

( * ) Notice: Subject to any disclaimer, the term of this patent is extended or adjusted under 35 U.S.C. 154(b) by 0 days.

(21) Appl. No.: 16/997,638

(22) Filed: Aug. 19, 2020

(65) Prior Publication Data

US 2021/0052045 A1 Feb. 25, 2021

Related U.S. Application Data

(60) Provisional application No. 62/889,472, filed on Aug. 20, 2019, provisional application No. 62/889,512, filed on Aug. 20, 2019.

(51) Int. Cl.
*A44C 5/00* (2006.01)
*A44C 5/16* (2006.01)

(52) U.S. Cl.
CPC ..... *A44C 5/003* (2013.01); *A44C 5/16* (2013.01)

(58) Field of Classification Search
CPC .. A44C 5/003; A44C 5/16; A44C 5/14; A45F 2005/008; Y10T 24/4782; G04B 37/0008; G04B 37/1496; G04B 37/16; G04B 37/18
USPC ..... 224/165, 267; 368/282
See application file for complete search history.

(56) References Cited

U.S. PATENT DOCUMENTS

| | | | | |
|---|---|---|---|---|
| 2,041,354 | A * | 5/1936 | Kestenman | A44C 5/185 24/265 WS |
| 2,400,222 | A * | 5/1946 | Cline | A45C 1/04 224/165 |
| 3,751,329 | A | 8/1973 | Fonzi | |
| 5,636,775 | A * | 6/1997 | Kartsotis | A44C 5/003 224/165 |
| D888,596 | S | 6/2020 | Frietsch | |
| 10,945,495 | B2 | 3/2021 | Frietsch | |
| 2007/0142883 | A1 | 6/2007 | Quincy | |
| 2007/0256284 | A1* | 11/2007 | Bauer | A44C 5/14 24/265 WS |
| 2015/0245939 | A1 | 9/2015 | Fruscione-Loizides | |
| 2016/0345704 | A1 | 12/2016 | Aussant | |
| 2017/0065041 | A1 | 3/2017 | Coats | |
| 2018/0084879 | A1 | 3/2018 | Parr | |
| 2018/0235325 | A1* | 8/2018 | Samardzija | A45F 5/00 |
| 2019/0239601 | A1 | 8/2019 | Frietsch | |
| 2021/0161257 | A1 | 6/2021 | Frietsch | |

OTHER PUBLICATIONS https://ringbandits.wixsite.com/mysite/shop (published online Nov. 18, 2016).
Ringbandit, Instagram Post (screenshot of video), Oct. 28, 2016, posted by "Ringbandits," https://www.instagram.com/p/BMHRMRajr7T/?igshid=1ska96z4pry6o (2016).
Instagram post by Ringbandits, Dec. 15, 2016.
Instagram post by Ringbandits, Apr. 15, 2016.

* cited by examiner

*Primary Examiner* — Jack W Lavinder
(74) *Attorney, Agent, or Firm* — Wendy Thai

(57) ABSTRACT

A wristband with a pocket for safekeeping small items is provided. Also provided herein is a wristband with a watch connector attached to each end of the wristband, as well as an accessory for wearing on the wrist that includes such a wristband.

20 Claims, 3 Drawing Sheets

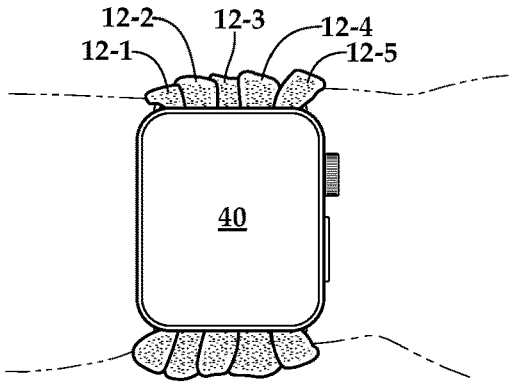
Fig.3A
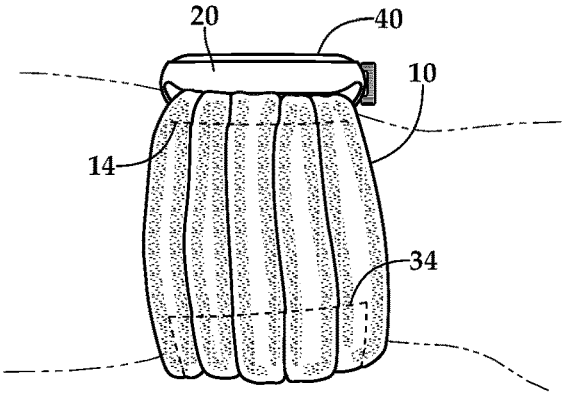
Fig.3B
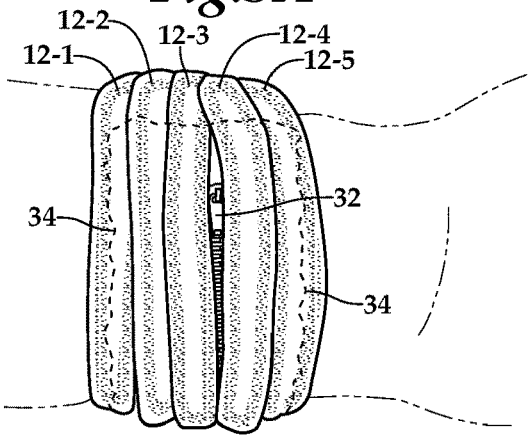
Fig.3C
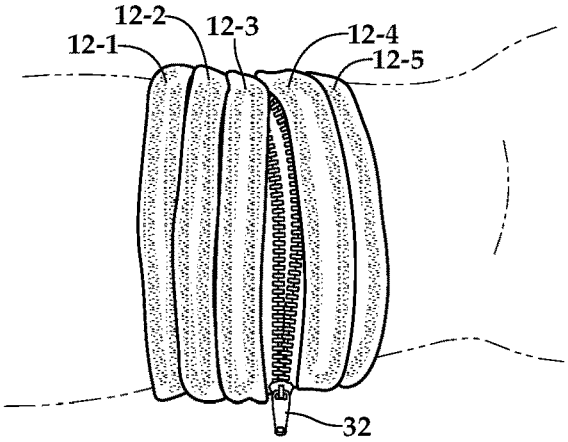
Fig.3D
Fig.4A
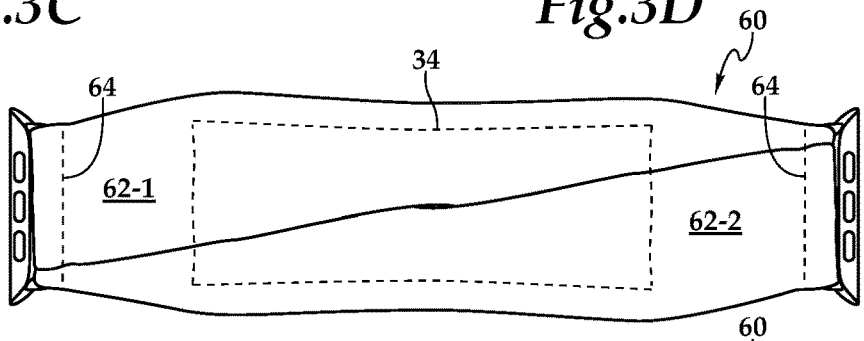
Fig.4B
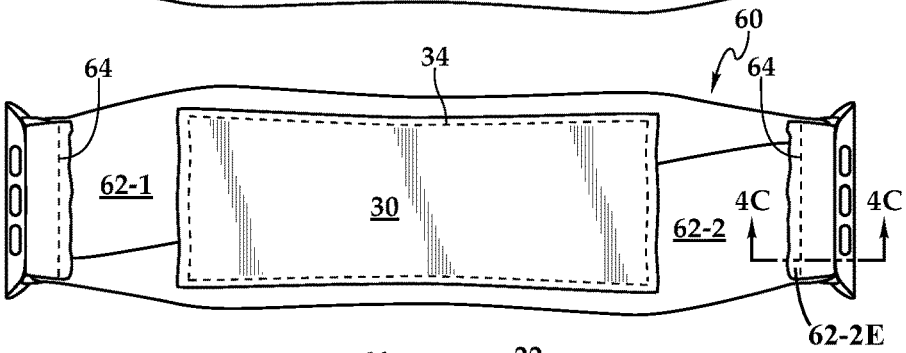
Fig.4C
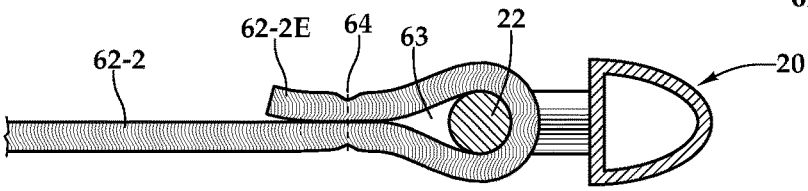

WRISTBAND WITH INTEGRATED POCKET

CROSS-REFERENCE TO RELATED APPLICATIONS

This application claims priority to U.S. provisional application No. 62/889,512, filed Aug. 20, 2019 and U.S. provisional application No. 62/889,472, filed Aug. 20, 2019, the contents of which are incorporated herein by reference in their entirety.

BACKGROUND

A wristwatch is a portable device useful for its multifunctional offerings as well as for its value as a fashion accessory. A wristwatch typically includes two straps that can be adjustably fastened one to the other to hold the watch on the wearer's wrist. The straps are typically constructed of a variety of materials including metal such as stainless steel or titanium, synthetic or natural leather, plastic, nylon, rubber such as silicon or polyurethane, as well as ceramic and wood that can be secured together by a buckle or a quick release connector to form a watchband that allow the watch to be securely fastened to the wearer's wrist.

SUMMARY

A wristband is provided that can be attached to a watch or similar device to form a fashionable accessary for wearing on the wrist. A wristband provided herein includes an integrated pocket, which allows the wristband to be used for safekeeping small items.

In one aspect, the present disclosure provides a wristband comprising (a) a first end and a second end; (b) a pocket attached to a side of the wristband between the first end and the second end for keeping small items; and (c) a closed loop at each of the first end and the second end for connecting with a watch connector.

In some embodiments, the wristband has a watch connector at each of the first end and the second end for removeably attaching the wristband to a watch.

In some embodiments, the pocket of the wristband has an opening configured with a fastener for maintaining the opening in a closed position.

In some embodiments, the fastener is a zipper or a hook and loop fastener.

In some embodiments, the pocket is attached to a surface of the wristband configured to face a wrist of the wearer.

In some embodiments, the wristband has a plurality of elongated segments, each having a first and a second segment end thereby forming a plurality of first segment ends and a plurality of second segment ends, wherein the plurality of first segment ends are secured together to form the first wristband end, and the plurality of second segment ends are secured together to form the second wristband end.

In some embodiments, the plurality of elongated segments is two, three, four, five, six, seven, or eight elongated segments.

In some embodiments, each elongated segment of the plurality of elongated segments extends from the first wristband end to the second wristband end without crossing over another elongated segment of the plurality of elongated segments.

In some embodiments, the plurality of elongated segments forms a criss-cross configuration.

In some embodiments, the pocket is attached to a side of the wristband such that the pocket opening accessible by parting one or more elongated segments of the plurality of elongated segments.

In some embodiments, the one or more elongated segments are positionable over the opening to cover the opening from view.

In some embodiments, each elongated segment of the plurality of elongated segments has a tubular, braided or flat structure.

In some embodiments, each elongated segment of the plurality of elongated segments is form of a cording material.

In some embodiments, the wristband is constructed of a knitted or woven material.

In some embodiments, the wristband, the pocket, or the wristband and the pocket comprise spandex, nylon, polyester, or a combination thereof.

In some embodiments, the wristband is constructed of an elastic material.

In some embodiments, the wristband, pocket, or the wristband and the pocket is constructed of a 4-way stretch material.

In some embodiments, the pocket is stitched to the wristband.

In some embodiments, the pocket is constructed of a swatch of material to which a zipper fastener or hook and loop fastener is stitched, the swatch of material and the fastener comprising edges that are co-extensive, and the swatch of material and the fastener being stitched along their co-extensive edges to form a pocket accessible through the fastener, and the stitching that secures the swatch of material and the fastener along their co-extensive edges secures the pocket to the wristband.

In some embodiments, a wristband provided herein can be constructed of a plurality of flexible or elastic tubular segments or sections arranged longitudinally or generally in a parallel configuration and stitched together at the ends to form a first end and a second end of the wristband. The plurality of flexible or elastic tubular segments that are longitudinally arranged in a generally parallel configuration also can be held in place, for example, by stitching. As used herein, the term "generally parallel" in reference to two or more segments means no segment of the two or more segments crosses over another segment of the two or more segments. Thus, each segment forming a wristband provided herein that is constructed of a non-rigid, flexible or elastic material can be in a generally parallel configuration if no segment crosses over another segment between a first end and a second end of the wristband. Where a wristband is constructed of a plurality of flexible or elastic tubular segments, an integrated pocket can be attached to the wristband such that its opening is adjacent the plurality of flexible or elastic tubular sections forming the wristband. As such, the plurality of flexible or elastic tubular sections can be parted to allow access to an integrated pocket.

In another aspect, the present disclosure provides a wristwatch with a wristband disclosed herein.

In another aspect, the present disclosure provides a wearable accessory for the wrist having a wristband disclosed herein.

In some embodiment, the wearable accessory includes cellular, wifi, bluetooth technology, or a combination thereof.

In some embodiment, the wearable accessory includes a GPS, a fitness tracker, a timer, a calculator, an alarm, or a combination thereof.

Any feature or combination of features described herein are included within the scope of the present invention provided that the features included in any such combination are not mutually inconsistent as will be apparent from the context, this specification and the knowledge of one of ordinary skill in the art.

Unless otherwise defined, all technical and scientific terms used herein have the same meaning as commonly understood by one of ordinary skill in the art to which this invention belongs. In case of conflict, the present specification, including definitions, will control. In addition, the materials, methods, and examples are illustrative only and not intended to be limiting. Although methods and materials similar or equivalent to those described herein can be used to practice the invention, suitable methods and materials are described below.

All patents and publications referenced or mentioned herein are indicative of the levels of skill of those skilled in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications.

BRIEF DESCRIPTION OF THE DRAWINGS

FIG. 3A-3D are four views of wristwatch 50 as it appears on a wrist including: a front view of wristwatch 50 (3A) in which the face of watch 40 is shown connected between a first and a second end of wristband 10; a side view of wristwatch 50 (3B) showing an end portion of wristband 10 being connected to watch 40 through watch connector 20; a first rear view of wristwatch 50 (3C) illustrating the exterior side of wristband 10 in which zipper 32 is partially visible and in a mostly closed position; and a second rear view of wristwatch 50 (FIG. 3D) illustrating the exterior side of wristband 10 in which zipper 32 is visible between elongated wristband segments 12-3 and 12-4 and zipper 32/pocket 30 is in an open position.

FIGS. 4A-4C are three views of wristband 60 including: a view of the exterior side (4A) illustrating two elongated segment 62-1 and 62-2 that form wristband 60 in a crisscross configuration; a view of the interior side or wrist-facing side (4B) illustrating pocket 30; and a cross-sectional view along line 4C-4C of an end of wristband 60 illustrating loop 63 formed between a portion near the end of segment 62-2 and end 62-2E through which bar 22 of watch connector 20 passes.

DETAILED DESCRIPTION

Figure 1A:
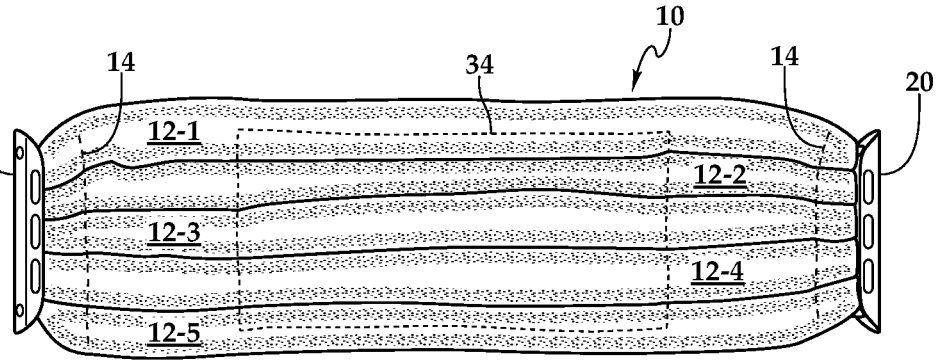
FIGS. 1A-1C are three views of wristband 10 including: a first view of the exterior side in which the pocket is hidden behind one or more band segments 12-1, 12-2, 12-3, 12-4 and 12-5 (1A); a second view of the exterior side in which the pocket is visible between elongated band segments 12-3 and 12-4 (1B); and a third view, which is a view of the interior side or wrist-facing side, illustrating pocket 30, which attached through stitching 34 (1C).

The present disclosure provides an elongated wristband extending from a first end to a second end, the wristband being constructed with a pocket on a side of the band for keeping small items and a closed loop at each of the first and the second end for connecting with a watch connector. The present disclosure also provides a wristband in which a watch connector is attached to each of the first and the second end for removeably connecting to a watch to form a wristwatch. The present disclosure further provides a wristwatch with a detachable band having a pocket for keeping small items.

Wristband Material

A wristband provided herein can be constructed using a flexible or elastic material. As such, when attached to a device that can be worn on a wrist such as a watch, the wristwatch can be placed on the wrist by insertion of the wearer's hand through the circular form of the wristwatch, the wristband stretching to accommodate of a wearer's hand as it is inserted.

As used herein, the term elastic in reference to a material for use in a wristband provided herein means the material can be stretched or extended by any mount, for example, by about 5%, 10%, 15%, 20%, 25%, 30%, 35%, 40%, 45%, or 50%, 55%, 60%, 65%, 70%, 75%, 80%, 85%, 90%, 95%, 100%, its original length, and up to seven times its original length, before recovering its original length when released or tension is removed.

A material that can be used in constructing a wristband provided herein include, for example and without limitation, spandex, elastane yarn, rubber core yarn, or a stretchy yarn of polyester, nylon or a natural fiber. The material can be synthetic such as spandex with various elastane content including between about 1%, to about 20%, for example, and without limitation, about: 1%, 2%, 3%, 4%, 5%, 6%, 7%, 8%, 9%, 10%, 11%, 12%, 13%, 14%, 15%, 16%, 17%, 18%, 19%, and 20%.

A material that can be used in constructing a wristband provided herein also includes various spandex blends, i.e. spandex fibers blended with natural or synthetic fibers including cotton, linen, silk and wool. Non-limiting examples of spandex blends include: cotton-spandex blends with percentage of spandex between about 1 to about 7%, for example, about: 1%, 2%, 3%, 4%, 5%, 6% and 7%; and nylon-spandex blends with percentage of spandex between about 10 to about 20%, for example, about: 1%, 2%, 3%, 4%, 5%, 6%, 7%, 8%, 9%, 10%, 11%, 12%, 13%, 14%, 15%, 16%, 17%, 18%, 19%, and 20%. A wristband provided herein can also be constructed using material having other spandex blends including, for example and without limitation: polyester-spandex blend, rayon knit-spandex, acetate-spandex, modal-spandex, tencel-spandex, linen-spandex, cotton-polyester-spandex (stretch denim), poplin-cotton-spandex (cotton poplin stretch).

A wristband provided herein can be constructed using a water-resistant or water repellant material including, for example, neoprene, rubber, latex, silicon, or rubber core yarns.

A wristband provided herein can be constructed using a knit fabric including, for example and without limitation, 3×3 rib knit, bamboo jersey, doubleknit rayon blend, interlock twist jersey, double knit, sweater knit, silk mesh knit, silk jersey. The wristband material can be an absorbent material such as, for example, stretch terry cloth.

A wristband provided herein can be constructed using material containing lycra, cotton, polyester, nylon, rayon, viscose, Dry Fit polyester, bamboo, supplex, tactel, organic cotton, tencel, polyamide, Power Net, Power Mesh, leg elastic, Revolutional Slim (anti-cellulite fabric), or any combination thereof.

A wristband provided herein can be constructed using material type discussed herein at about the following percentages: 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, 90%, 91%, 92%, 93%, 94%, 95%, 96%, 97%, 98%, 99%, and 100%.

A wristband provided herein can be constructed using a fabric having spandex, elastane, Italian lycra, spandura, equestrian lycra, wicking lycra, cotton lycra, supplex lycra, super stretch spandex, Poly Net, Poly Mesh, leg elastic, or any combination thereof at about the following percentages, for example, about: 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32% 33%, 34%, 35%, 36%, 37%, 38%, 39%, and 40%. A wristband provided herein can be constructed using material having 81.2% nylon and 18.8% spandex.

The spandex, elastane or stretchy yarn content can be selected to achieve a percentage of stretch between about 10% to about 50%, or preferably, between about 20% to about 35%, for example, about: 21%, 22%, 23%, 24%, 25%, 26%, 27%, 28%, 29%, 30%, 31%, about 32%, 33%, 34%, or 35%.

A wristband provided herein can be constructed using fold over elastic (FOE) having a heavier weight, for example and without limitation, a weight over about: 350 grams per meter square (GSM), over about 375 GSM, over about 400 GSM, over about 450 grams per meter square (GSM), over about 475 GSM, over about 500 GSM, over about 550 GSM, or over about 600 GSM. A wristband provided herein can be constructed using FOE having greater thickness, for example and without limitation, a thickness of about 1/32 inch, over about 1/32 inch, about 1/16 inch, or over about 1/16 inch.

A wristband provided herein can be constructed using material with a solid color, any abstract or non-abstract print, or a finishing selected to achieve a particular appearance such as a distressed appearance, a vintage appearance, or a burnout or laser cut appearance. The material can have a solid color or an acid-washed color.

A wristband provided herein can be constructed using a plurality of band segments, each having a tubular structure with an internal pore. The internal pore can be hollow or can contain a support or cushion material of any color, look or feel. Where a wristband provided herein has a twisted, braided or woven structure, the yarns, fibers or components that are twisted, braided or woven can have a variety of colors, texture, weight and/or print. For example, red, white and blue yarns can be braided or woven together to form a wristband with an Americana theme. A wristband provided herein can be customized by incorporating one or more colors, print or design to reflect team color(s) and/or to indicate association with, or support of, a select cause, organization or institution.

Wristband Structure

A wristband of the present disclosure can be constructed of a single wristband segment or a plurality of segments arranged longitudinally and then fused or fixed at two positions by stitching, using an adhesive or heat bonding to form a single wristband.

Thus, in some embodiments, a wristband provided herein can include one or more elongated band segments extending from a first end of the wristband to a second end of the wristband. A wristband provided herein can include a plurality of elongated band segments extending from a first end of the wristband to a second end of the wristband. See, for example, FIG. 1A. Each elongated band segment has a first end and a second end. Where a wristband includes a plurality of elongated band segments, the first ends of the plurality of elongated band segments are secured together to form a first end of the wristband, and the second ends of the plurality of elongated band segments are secured together to form a second end of the wristband.

Each of the first end and the second end of a wristband provided herein is constructed with a closed loop for forming a link with a watch connector. For example, FIG. 4C provides a cross-sectional view of an end of wristband 60 (FIG. 4A) illustrating loop 63 formed between (a) a portion of segment 62-2 and (b) segment end 62-2E. Loop 63 encircles watch connector bar 22 thereby forming a link with watch connector 20.

The closed loop at each of the first and second ends of which loop 63 is an example can be formed by folding each end of the segment back and attaching the folded end to an earlier portion of the segment. The closed loop can be formed by passing the end of a wristband segment through the gap between the bar and the clasp of the watch connector (see FIG. 5A, bar 22, gap 23) and then folding the end back and securing the folded end to an earlier portion of the segment to form a closed loop around the connector bar. Alternatively, a watch connector with a spring-loaded bar can be attached to a pre-formed wristband loop by insertion of the spring-loaded bar into the loop at each end and then attaching the spring-loaded bar to a watch connector clasp (i.e. FIG. 5A, clasp 24). Watch connectors are well known in the art and can be referred to as a watch adapter or a watch converter. A watch connector generally includes a bar cooperating with a clasp that form a D-style link allowing an end of a wristband to connect to a watch. See, for example, watch connector 20 with clasp 24, bar 22 and gap 23. Watch connectors are well known in the art and can be obtained from a variety of sources including, for example and without limitation, Barton Watch Bands, which can be found at https://www.bartonwatchbands.com; https://amazon.com; https://www.esslinger.com; and http://www.julesborel.com/products/Watchband-End-Converters (last visited Aug. 17, 2020).

A wristband provided herein includes one or more elongated band segments or a plurality of elongated band segments. As used herein, the term "plurality" means two or more, for example, two, three, four, five, six, seven or more than seven. Thus, a wristband provided herein can have two, three, four, five, six, seven, or eight or more elongated band segments.

The plurality of elongated band segments in a wristband provided herein can be arranged without a segment crossing over or under another segment as exemplified by wristband 10. More specifically, the left ends of the five elongated segments forming wristband 10 are attached to connector 20 on the left in the same segment order or sequence as that in which the right ends of the five elongated segments are attached to connector 20 on the right, i.e. segment 12-1, followed by 12-2, which is followed by 12-3, then 12-4 and 12-5. As such, segments 12-1, 12-2, 12-3, 12-4 and 12-5 remain in the same relative position, sequence or order as the segments extend from a first end to a second end, e.g. from the left end to the right end of the wristband 10.

Alternatively, one or more of the elongated band segments can be arranged so that at least one segment crosses over (or under) at least one other segment to form a wristband having a random crisscross configuration or a regular intertwining configuration such as braiding or two, three, four, five, six, seven or eight or more elongated bands.

To form a wristband having a random crisscross configuration, a first end of each of a plurality of elongated segments can be attached to a first watch connector in a particular segment order or sequence, and the other or second end of each of the plurality of segments can be attached to a second watch connector in a different segment order or sequence so that at least one segment of the plurality of segments cross over one or more of the other segments as they extend from a first end to a second of the resulting wristband. For example, where a wristband is constructed using five segments, i.e. on a first end of a wristband, e.g. a right end, the segments can be attached to a first watch connector in a first sequence, i.e. segment 13-1, followed by 13-2, which is followed by 13-3, then 13-4 and 13-5, while on the other or second end of the wristband, the segments can be attached to a second connector in a different order or sequence, for example and without limitation: (a) segment 13-1, followed by 13-3, which is followed by 13-4, then 13-5 and 13-2; (b) segment 13-1, followed by 13-4, which is followed by 13-5, then 13-2 and 13-3; or (c) segment 13-1, followed by 13-5, which is followed by 13-2, then 13-3 and 13-4. In short, the left and right ends of the wristband can be attached to a watch connector in any order or sequence so long as the order or sequence are different between the first end and the second end. An example of a wristband segment having a criss-cross configuration is wristband 60 illustrated in FIG. 4A-4B. Wristband 60 includes two elongated segments, in particular, segment 62-1 and 62-2, which are shown in FIG. 4A as forming a crisscross about the center of wristband 60. A wristband provided herein can have a wristband configuration as disclosed in U.S. patent application Ser. Nos. 16/269,543 and 62/627,562, the contents of which are herein incorporated by reference in their entirety. The wristband can have a crisscross configuration or structure resembling that of any of the wristbands disclosed in U.S. patent application Ser. Nos. 16/269,543 and 62/627,562.

Each of the elongated band segment forming a wristband provided herein can have a tubular structure or a flat structure. The elongated band segment can have a braided, woven or twisted structure formed of three of more threads or fibers. For example, each of the elongated band can be formed using flat cording. Alternatively, each of the elongated band can have a tube-like structure with a hollow interior formed by sewing the longitudinal edges of an elongated strip of material together, for example, using a serger to form a serged hem. In these embodiments, where the right side (i.e. printed side) of material are stitched together, when turned right side out, the serged longitudinal hem occupies the interior bore of the tubular structure and provides support. Each of the elongated band can be woven, twisted, or braided using, for example, any number of straps material or strands of thread, yarn or material.

The plurality of elongated band segments in a wristband provided herein can be closely assembled such that there is little or no space or gaping between adjacent segments in their unstretched state.

The plurality of elongated band segments can be maintained in a select arrangement or configuration using any convenient attachment methods including, for example, stitching or using an adhesive, by heat bonding, by knotting or tying, using one or more fasteners or any combination thereof. The stitching, adhesive, heat bonding, knotting, one or more fasteners or any combination of attachment methodologies can be applied at any convenient location on the wristband or at any location between the ends of the plurality of elongated band segments. For example, in wristband 10 (FIG. 1C), stitching 14 is used to secure each fold-over end of wristband 10 so as to form a loop that is linked to connector 20. Similarly, in wristband 60 (FIG. 4B), stitching 64 secures each foldover end of wristband 60 in a loop configuration.

Thus, each elongated band segment in the plurality of elongated band segments can be secured to one or more adjacent bands or a portion of an elongated band segment such as an end portion can be secured to another portion of the same band segment. One or more elongated band segments of the plurality of elongated band segments can be secured to a pocket as further discussed below.

Where stitching is used, the stitching can be in any direction useful for maintaining the band in a select configuration including longitudinally, transversely, or diagonally with respect to the length of the band. Any type of stitching can be used including those that utilize two or more threads to create a two-, three-, four- or five-thread seam, to generate a straight seam, a seam with some stretch capability such as a serged seam, a chain stitch, safety stitch, or an overlock edge. Fastening means for maintaining the structure of the wristband or for maintaining the plurality of elongated band segments in a select configuration can be used at any convenient position on the wristband. For example, at each end of an elongated band such as stitching 14 of wristband 10 (FIG. 1A-1C) or stitching 64 of wristband 60 (FIG. 4A-4B).

A wristband can have any convenient length such that when attached to a wrist-wearable device such as a watch, the resulting wearable accessory is of a size effective to receive a human hand inserted through its circular form to allow the accessory to be placed on the wrist by stretching of the band. A wristband can be, for example, about 3 inches, about 3.5 inches, about 4 inches, about 4.5 inches, about 5 inches, about 5.5 inches, about 6 inches or about 6.5 inches in length.

Integrated Pocket

A wristband provided herein includes an integrated pocket for holding small items. The pocket can be used for safe keeping of valuables such as a ring, earrings, other jewelry, one or more coins, cash, a key, or an identification card.

The pocket is affixed to a side of the wristband. The integrated pocket can be affixed to the band on the side of the band configured to face the wrist, i.e. the wrist-facing side of the wristband. As such, when the wristwatch is worn on the wrist, the pocket can be tucked between the wrist of the wearer and the wristband. Thereby enabling the integrated pocket to be partially or mostly hidden.

The pocket can be formed using the same or different material used for the wristband as disclosed above.

The pocket can have any shape or dimension so long as it fits comfortably between the wristband and the wrist of the wearer. The pocket can be constructed with a thin profile, in which case, its dimensions or footprint would be no greater than that of the wristband. In some embodiments, the pocket need not be hidden or have a thin profile, in which case, the pocket can have any shape, dimension or structure including a pocket with one or more foldable or collapsible sides.

In some embodiments, the pocket can be formed by securing a swatch of material of a select size to a portion of the wrist-facing side of the wristband. As such, a pocket chamber for storing small items is formed between the wristband and the swatch of material. The pocket can also be formed by securing two swatches of material of similar or different select sizes to a portion of the wrist-facing side of the wristband. The pocket chamber for storing small items is then formed between the two swatches of material, as well as between the inner swatch and the wristband. The pocket can be formed by securing one or more swatchs of material to the wrist-facing side of the wristband so as to form a pouch or an accordion-style pocket rather than a flat pocket. As such, the pouch can be folded or collapsed to a flatter or thinner profile when on the wearer's wrist. The pocket can be formed by stitching a swatch of material to a zipper along their edges to form a pocket chamber between the swatch of material and the zipper/tape of the zipper.

More specifically, the pocket is first formed by securing a swatch of material to a zipper, specifically the tapes of the zipper, along their edges to form a pocket chamber between the zipper and the swath of material. In these embodiments, each tape of the zipper can be secured to an adjacent or cording segment thereby forming an opening between adjacent or stacked coding segments accessible through the zipper.

The pocket can be constructed with an opening for accessing the pocket chamber. The opening can be an outward-facing slot accessible between adjacent band segments as shown in FIGS. 1B and 3D. The opening can be on an edge of the pocket, for example, a portion of the edge nearest to the hand of the wearer, i.e. hand-proximal edge, or a portion for the edge farthest from the hand of the wearer, i.e. the hand-distal edge of the pocket. As such, the wearer can insert a small item such as a ring or a folded bill by sliding it into the pocket in a direction along the forearm, for example, from the wrist to the elbow, or elbow to wrist.

The opening can be fitted with a fastener to enable items to be securely held in the pocket chamber. Fasteners useful for securing the opening of the pocket include, without limitation, a zipper, a hook-and-loop fastener, a button- or toggle-and-loop combination, one or more hook and eye fasteners, one or more snaps or poppers, or any combination thereof. In some embodiments, an adhesive or a spring mechanism can be used.

In other embodiments, the pocket opening is not fitted with a fastener. In these embodiments, items stored in the pocket such as a small piece of jewelry or a folded dollar bill can be held smugly though compression of the wristband material on the wrist and/or through steric hindrance presented by the two- or three-dimensional structure of the wristband or wrist.

In general, a wristband provided herein includes a closed loop on each of its first and second end that can be attached to a watch connector to allow the wristband to be connected to a watch to form a wristwatch that can slide over a wearer's hand and worn on the wearer's wrist.

Wrist Accessories

A wristband disclosed herein can be connected to any device that can be worn on the wrist. A wristband disclosed herein can be connected to a wearable mechanical or electronic device including a cellular, Bluetooth and/or wifi enable device. For example, a wristband provided herein can be connected to a watch, a communication device such as a smartphone or smartwatch, a GPS device, a fitness tracker. A wristband disclosed herein can be connected to an Apple Watch, fitbit versa or the like including, for example, a Samsung Galaxy Watch, Fossil Q Explorist HR, Huawei Watch 2, Withings Steel HR Sport, Ticwatch E2, Garmin, Michael Kors Access Runway, Xiaomi, Polar, Suunto, Withings, TomTom, Misfit, Huawei or Nike.

A wristband provided herein can be attached to a device that can be worn on the wrist using any convenient fastening mechanism known in the art. The fastening mechanism can be a watch connector as discussed herein and known in the art. In these embodiments, the first and second end of the wristband can each include a watch connector. The fastening mechanism can also be a hook and loop fastener, which can allow a wristband end to form a loop linking a wristband end to a wearable device. In these embodiments, each of the first and second end of a wristband provided herein can include a hook and loop fastener to allow the end to form a detachable closed loop that can form a link to a wearable device. Hook and loop fasteners are known to those of skill in the art. Additional examples of fastening mechanisms that can be used include a D-ring, a button, clip or snap.

The following Examples illustrate but do not limit the scope of the invention set out in the claims.

EXAMPLES

Example 1—Wristband with Pocket

Figure 1B:
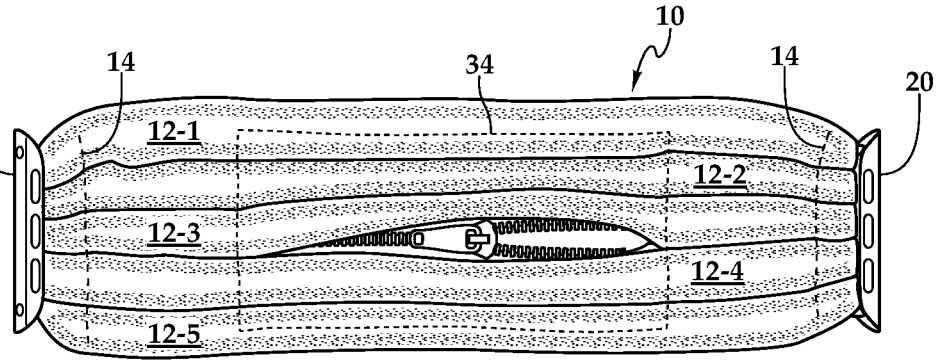
Figure 1C:
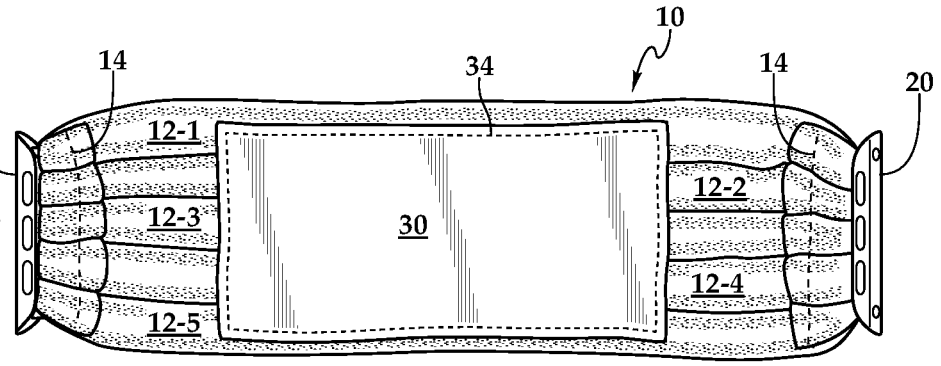

An embodiment of a wristband with an integrated pocket is illustrated in FIGS. 1A-1C, which provides three views of wristband 10. Wristband 10 has a first end and a second end, each of which is shown attached to watch connector 20 for removably connecting to a watch.

Wristband 10 has a plurality of elongated wristband segment 12 including segment 12-1, 12-2, 12-3, 12-4 and 12-5. In the embodiment shown in FIGS. 1A-1C, each band segment 12-1, 12-2, 12-3, 12-4 and 12-5 extends from a first segment end to a second segment end without crossing over another elongated band segment of the plurality of elongated band segments 12 (FIGS. 1A-1B).

Wristband 10 includes pocket 30 attached on a side as shown in FIGS. 1B and 1C. Pocket 30 has opening 33 configured with zipper 32 to allow pocket 30 to open or close. Pocket 30 is positioned on wristband 10 such that zippered 32/opening 33 is beneath one or more of band segments 12-2, 12-3 and 12-4 (FIG. 1B). As such, one or more of band segment 12-2, 12-3 and 12-4 can be parted to allow access to zipper 32/opening 33 (FIG. 1B). Alternatively, band segment 12-2, 12-3 and 12-4 can be positioned over zipper 32/opening 33 thereby shielding zipper 32/opening 33 from view (FIG. 1A).

Example 2—Wristwatch with Pocket

Figure 2:
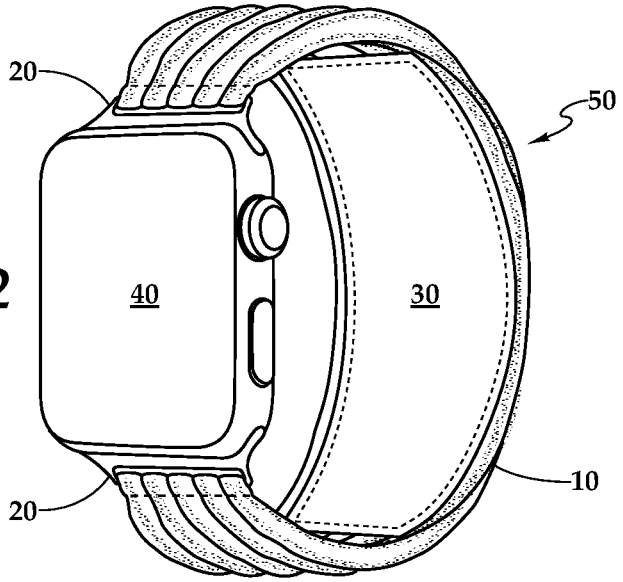
FIG. 2 is a perspective view of a wristwatch 50 in which wristband 10 is removably connected to watch 40 through watch connector 20.

An embodiment of a wristwatch with an integrated pocket is illustrated in FIG. 2, which provides a perspective view of wristwatch 50. Wristwatch 50 includes watch 40, to which each end of wristband 10 is attached through watch connector 20. Pocket 30 is on the inside or wrist-facing surface of wristwatch 50 and is attached to wristband 10 by seam 34 (FIG. 3B, 3C). As such, pocket 30 can be tucked between the wearer's wrist and wristband 10 and can be shielded from view.

FIGS. 3A-3D illustrate wristwatch 50 as it appears on the wearer's wrist. FIG. 3A provides a face view of wristwatch 50. FIG. 3C provides a side view, and FIGS. 3C and 3D provides two rear views. A shown in FIGS. 3C and 3D, when wristwatch 50 is worn on a wrist, one or more of wristband segments 12-2, 12-3 and 12-4 can be parted to allow access to pocket 30 as illustrated in FIG. 2E or to partly or fully shield pocket 30 from view as illustrated in FIGS. 2C and 2D.

Example 3—Additional Embodiments of Wristbands with Pocket

Another embodiment of a wristband with a pocket is illustrated in FIGS. 4A-4C. Wristband 60 is constructed using two flat segments 62-1 and 62-2 extending from a first end to a second end of wristband 60. Each of the first and second ends of wristband 60 forms loop 63 (FIG. 4C) with which watch connector 64 forms a link to allow wristband 60 to attach to a watch. Wristband 60 also includes pocket 30 attached to wristband 60 through seam 34. Pocket 30 can be used for keeping small items (FIG. 4B). Each end of segments 62-1 and 62-2 is attached to watch connector 64 such that segments 62-1 and 62-2 form a criss-cross configuration as shown in FIG. 4A. Wristband segments 62-1 and 62-2 are positioned over pocket 30 therefore shielding pocket 66 from view. Wristband segments 62-1 and 62-2 can be parted or lifted for access to pocket 30.

Figure 5A:
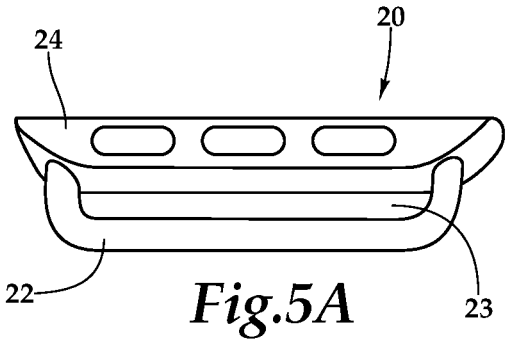
FIGS. 5A-5C are schematic illustrations of exemplary components of a wristband provided herein including watch connector 20 (5A) and two views of pocket 30: a zipper side view (5B) and a view of pocket back 34 (5C).
Figure 5B:
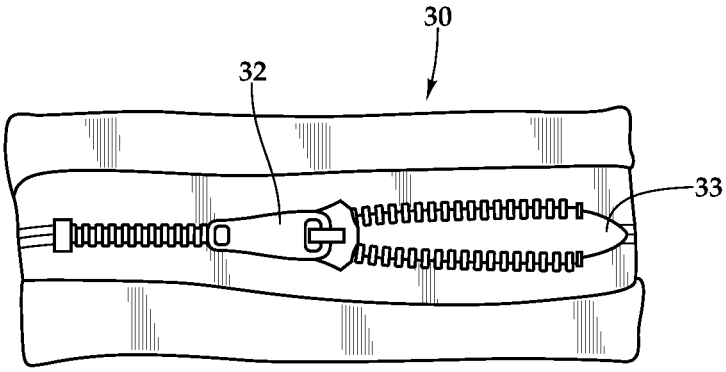
Figure 5C:
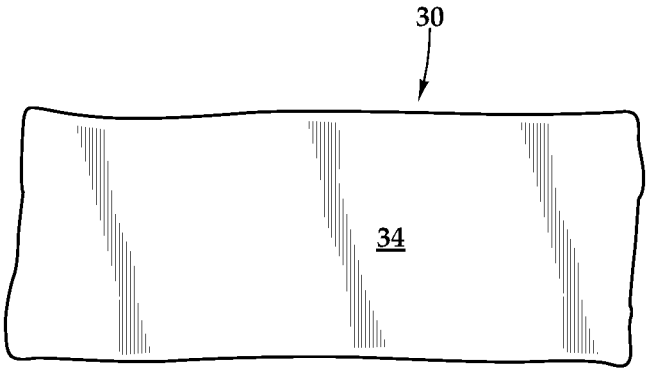

Exemplary components of a wristband provided herein are shown in FIGS. 5A-5C.

Watch connector 20 (FIG. 5A) is used to attach a wristband provided herein to a watch. Connector 20 includes: (a) watch clasp 24, which attaches to the watch; (b) connector bar 22, which passes through a loop at an end of a wristband provided herein as shown in FIG. 4C to form a link; and (c) gap 23 through which the wristband loop end passes through to form the link (FIG. 4C).

Pocket 30 (FIG. 5B-5C) exemplifies an embodiment of a pocket that can be integrated in a wristband provided herein. Pocket 30 has a rectangular structure constructed with zipper 32 that form opening 33 and pocket back 34. Pocket 30 is attached to a wristband 10 such that zipper 32 faces one or more elongated segment 12. The one or more elongated segment 12 can be parted to allow access to pocket opening 33. Pocket 30 is attached to a wristband 10 by stitching as represented by seam 34. Pocket 30 is formed and then attached to the plurality of elongated segment 12. In alternative embodiments, a pocket can be formed as it is attached one or more elongated segment 12.

Example 4—Method of Constructing a Wristband with Pocket

Five elongated wristband segments, i.e. elongated wristband segment 12-1, 12-2, 12-3, 12-4 and 12-5, were used to produce wristband 10. Each of band segment 12-1, 12-2, 12-3, 12-4 and 12-5 has a tubular structure with a first end and a second end. To form band segment 12-1, 12-2, 12-3, 12-4 and 12-5, a rectangular fabric was folded longitudinally and the long edges of the folded fabric were stitched together. The resulting tubular segments were turned right-side out to form elongated wristband segment 12-1, 12-2, 12-3, 12-4 and 12-5 having a tubular structure extending from a first end to a second end.

To form wristband 10, wristband segment 12-1, 12-2, 12-3, 12-4 and 12-5 were attached to watch connector 20 as follows. A first end of each of tubular segment 12-1, 12-2, 12-3, 12-4 and 12-5 was inserted through loop 23 of connector 20. Each inserted first end was folded over bar 22 and stitched to a portion of one or more of segment 12-1, 12-2, 12-3, 12-4 and 12-5 on the other side of bar 22 to form a loop encircling bar 22. The foldover and stitched first ends were singed to prevent fraying. The second end of each of tubular segment 12-1, 12-2, 12-3, 12-4 and 12-5 were similarly attached to a second connector 20. Generally, the elongated segments were arranged such that the longitudinal seems on the segments are internal, hidden, or not on the outward-facing side of the wristband for enhanced aesthetic appeal.

To form wristband 10, the wristband segments were arranged and attached to connector 20 such that each of segments 12-1, 12-2, 12-3, 12-4 and 12-5 extended from the first end to the second end without crossing over another segment.

To form wristband 60, segment 62-1 and 62-2 were arranged so that one segment crossed over the other of segment to form the crisscross configuration shown in FIG. 3A. The resulting configuration is maintained through the stitching at the first end or the second end of segment 62-1 and 62-2 that formed the loop linking each of the first end and the second end of wristband 60 to band connector 20.

To produce pocket 30 (FIG. 5B-5C), a zipper was sewn to a rectangular piece of fabric cut to a select size as known to those of skill in the art. More specifically, the long and short free edges of the tape of closed zipper 32 are stitched to the edges of the piece of fabric to form a closed chamber with opening 33 formed by zipper 32. The resulting pocket 30 was placed on the wrist-facing side of a wristband and positioned such that the zipper 32 and zipper side of pocket 30 face or contact the wristband, and the closed side of the pocket (FIG. 5C, pocket side 34) is exposed on the wristband. Pocket 30 was positioned so that zipper 32/opening 33 faces one or more elongated segments of wristband 10 and stitched in place along the edges of the pocket—the upper edge of pocket 30 being stitched to an edge segment, e.g. segment 12-1 of wristband 10, and the lower edge of pocket 30 being stitched to the other edge segment, e.g. segment 12-5 of wristband 10. As such, pocket opening 33 is partially or fully covered by one or more elongated wristband segments, which could be lifted, parted or moved aside to uncover zipper 32 and/or opening 33 or positioned over zipper 32 and/or opening 33 to shield zipper 32 and/or opening 33 from view when the wristwatch is worn on a wrist.

Example 5—Materials for Constructing a Wristband

The following provides a summary of exemplary materials that can be used to construct a wristband with a pocket as provided herein.

| | |
|---|---|
| Corvito 66, style #10105, BLACK<br>80% Nylon 66/20% Spandex<br>Weight 190 GSM<br>Width 58/60"<br>Cool Sensation Touch | 10150 SH Silver (Shiny) Tricot 80%, Nylon 20%<br>032<br>82% Nylon, 18% Spandex<br>Weight 210 GSM<br>Width 58/60"<br>Durable 4-way stretch shiny fabric with smooth texture |
| 10100 SP Blush<br>82% Nylon, 18% Spandex<br>Weight 210 GSM<br>Width 58/60" | English Garden Brown<br>#10100, SP 013<br>Polyester Spandex<br>Width 58/60" |

-continued

| | |
|---|---|
| 50+ | |
| Zippy Tee | Gypsy |
| Polyester Spandex | 82% Nylon, 18% Spandex |
| Width 58/60" | Weight 210 GSM |
| | Width 58/60" |
| | 50+ |
| | 4-Way Stretch Nylon Spandex; Durable 4-way stretch shiny fabric with smooth texture. |
| Nylon/Spandex (25%/75%) | Nylon/Spandex (50%/20%) |
| 4 way stretch | 4 way stretch |
| Weight Medium | Medium Weight |
| Nylon/Spandex (25%/75%) | Nylon/Spandex (25%/75%) |
| 4 way stretch | 4 way stretch |
| Weight Medium | Weight 9.4 oz/yd |
| Polyester Spandex | |
| 240 GSM | |

Other Embodiments

The materials, methods, examples and embodiments described herein are illustrative and not intended to be limiting. Methods and materials similar or equivalent to those described herein can be used to construct a wristband provided herein. An element or limitation that is not specifically disclosed as essential can be omitted. The methods described herein may be practiced in differing orders of steps. Any combination of elements described herein that does not render a wristband inoperable as apparent from context, this specification and to those skilled in the art is included within the scope of the present disclosure. The wristband also has been described broadly and generically herein. Each narrower species and subgeneric groupings falling within the generic disclosure form part of the invention.

As used herein, the singular forms "a," "an," and "the" include plural reference unless the context clearly dictates otherwise.

The term "about" in reference to a numeric value means within 10% of the specified value. A number is "about" a reference value if the number is within a range that is + or −10% of the reference value.

What is claimed is:

1. A wristband comprising (a) a plurality of elongated segments, each comprising a first segment end and a second segment end; (b) a first wristband end comprising a plurality of the first segment end and a second wristband end comprising a plurality of the second segment end, wherein each of the first wristband end and the second wristband end is configured as a closed loop for connecting with a watch connector; and (c) a pocket attached to a side of the wristband between the first wristband end and the second wristband end for keeping small items.

2. The wristband of claim 1, further comprising a watch connector attached to each of the first wristband end and the second wristband end for removeably attaching the wristband to a watch.

3. The wristband of claim 1, wherein the pocket comprises a pocket opening configured with a fastener to enable the pocket to be closed.

4. The wristband of claim 3, wherein the fastener is a zipper or a hook and loop fastener.

5. The wristband of claim 3, wherein the pocket opening is configured to be accessible by parting one or more elongated segments of the plurality of elongated segments.

6. The wristband of claim 5, wherein the one or more elongated segments are positionable over the pocket opening to cover the pocket opening from view.

7. The wristband of claim 1, wherein the pocket is attached to a surface of the wristband configured to face a wrist of the wearer.

8. The wristband of claim 1, wherein the plurality of elongated segments is two, three, four, five, six, seven, or eight elongated segments.

9. The wristband of claim 1, wherein each elongated segment of the plurality of elongated segments extends from the first wristband end to the second wristband end without crossing over another elongated segment of the plurality of elongated segments.

10. The wristband of claim 1, wherein the plurality of elongated segments comprises a criss-cross configuration.

11. The wristband of claim 1, wherein each elongated segment of the plurality of elongated segments comprises a tubular, braided or flat structure.

12. The wristband of claim 1, wherein each elongated segment of the plurality of elongated segments comprises a cording material.

13. The wristband of claim 1, which comprises a knitted or woven material.

14. The wristband of claim 1, wherein the wristband, the pocket, or the wristband and the pocket comprise spandex, nylon, polyester, or a combination thereof.

15. The wristband of claim 1, which comprises an elastic material.

16. The wristband of claim 1, wherein the wristband, pocket, or the wristband and the pocket comprise a 4-way stretch material.

17. The wristband of claim 1, wherein the pocket is stitched to the wristband.

18. The wristband of claim 1, wherein:

(a) the pocket comprises a swath of material to which a zipper fastener or hook and loop fastener is stitched, the swath of material and the fastener comprising edges that are co-extensive, and the swath of material and the fastener being stitched along their co-extensive edges to form a pocket accessible through the fastener, and (b) the stitching that secures the swath of material and the fastener along their co-extensive edges secures the pocket to the wristband.

19. A wristwatch comprising the wristband of claim 1.

20. The wristband of claim 1, wherein the first wristband end and the second wristband end each comprises stitching securing each of the first wristband end and the second wristband end in the closed loop configuration.

* * * * *